US006699059B2

(12) United States Patent
Nagamine et al.

(10) Patent No.: US 6,699,059 B2
(45) Date of Patent: Mar. 2, 2004

(54) ELECTRICAL CONNECTOR ASSEMBLY COMPRISING LOCKING PART

(75) Inventors: Akira Nagamine, Aichi (JP); Takashi Iida, Aichi (JP)

(73) Assignee: J.S.T. Mfg., Co., Ltd., Osaka (JP)

( * ) Notice: Subject to any disclaimer, the term of this patent is extended or adjusted under 35 U.S.C. 154(b) by 0 days.

(21) Appl. No.: 10/131,307

(22) Filed: Apr. 24, 2002

(65) Prior Publication Data

US 2002/0160645 A1 Oct. 31, 2002

(30) Foreign Application Priority Data

Apr. 26, 2001 (JP) ..... 2001-130061

(51) Int. Cl.[7] ..... H01R 29/00
(52) U.S. Cl. ..... 439/352; 439/188
(58) Field of Search ..... 439/352, 507, 439/488, 188

(56) References Cited

U.S. PATENT DOCUMENTS 5,816,840 A 10/1998 Dullin ..... 439/352
6,364,683 B1 * 4/2002 Kohno ..... 439/352
6,419,510 B2 * 7/2002 Shiraki et al. ..... 439/188

FOREIGN PATENT DOCUMENTS

EP 0591947 A2 4/1994 ..... H01R/13/639
EP 0734100 A2 9/1996 ..... H01R/13/627
WO WO 00/04609 1/2000 ..... H01R/13/369

OTHER PUBLICATIONS

European Search Report, dated Jul. 11, 2002, 3 pages.

* cited by examiner

*Primary Examiner*—Khiem Nguyen
(74) *Attorney, Agent, or Firm*—Rosenthal & Osha L.L.P.

(57) ABSTRACT

An electrical connector assembly of the present invention includes a first component for supporting a first electrical connector element; a second component for supporting a second electrical connector element inserted in the first electrical connector element to be fitted therein; a short-circuit element, fitted in the first component, for electrically short-circuit the first electrical connector element; and a locking element engageable with the second component in a locked manner. The locking element is so structured that when the second component is inserted in the first component to be fitted therein, the locking element can make the short-circuit element move back to its non-short-circuit position and also can move to engage with the first component. The engagement of the locking element with the first component allows the first component and the second component to be locked against disconnection. The connecting motion of the both components and the pressing motion of the locking element for the release of the short circuit can be performed in the same motion.

8 Claims, 14 Drawing Sheets

ELECTRICAL CONNECTOR ASSEMBLY COMPRISING LOCKING PART

BACKGROUND OF THE INVENTION

1. Technical Field of the Invention

The present invention belongs in a technical field of an electrical connector assembly. Particularly, the present invention relates to an electrical connector assembly comprising a first component and a second component having a locking element which permits electrical contact points of the first component to be short-circuited with each other when the first component and the second component are not adequately connected with each other and permits the short-circuit to be released when those components are adequately connected with each other.

2. Description of the Prior Art

An airbag system comprises an airbag assembly and an electric or electronic control system which are assembled in a hidden compartment of a driver's cabin of a vehicle. The control system is connected with the airbag assembly via a wire harness. The wire harness is provided with a typical electrical plug and jack connector assembly, to allow a simple way for the airbag assembly and the control system to be electrically interconnected after assembled separately.

This connector assembly is provided with a so-called short-circuit clip. The short-circuit clip is a small metal element arranged in such a manner that the wires can be electrically short-circuited with each other within the plug or jack before the plug and the jack are engaged. The short-circuit clip is arranged as a safety device to prevent improper operation of the airbag assembly caused by leakage of electrical charge or improper connection in the course of production.

When the electrical connector assembly is accurately connected, the safety device using the short-circuit clip intended for electrical short circuit must be shifted to a non-short-circuit position. U.S. Pat. No. 5,275,575 and JP Patent No. 2647336 disclose the electrical connector assembly with locking element which is so designed as to release the electrical short circuit provided by the safety device. This electrical connector assembly is so structured that it does not operate until the components are both put in their completely engaged position and the locking element is shifted to its locking position. Also, the locking element serves to prevent the both components of the connector assembly from being disconnected accidentally after combined.

However, to bring the electrical connector assembly into the completely connected state requires a two-step motion comprising the first step motion of inserting the both components for fitting to each other and the second step motion of inserting the locking element into the both component to its locking position. Besides, the locking element is integrally mounted on one of the both components via a flexible arm, and as such provides an increased size of the one of the components and thus makes it hard to handle the electrical connector assembly.

Also, U.S. Pat. No. 5,314,345 and JP Patent No. 2647335 disclose the electrical connector assembly that is so designed that the electrical short circuit by the short-circuit clip can be released by the accurate connection of the both components, while also, the connection between the both components can be prevented from being disconnected accidentally by the insertion of the locking element.

However, in those references also, to bring the electrical connector assembly into the accurately connected state requires the same two-step motion, as is the case with U.S. Pat. No. 5,275,575. In addition, the provision of the locking element provides an increased size of the one of the components and thus makes it hard to handle the electrical connector assembly.

Thus, the both types of electrical connector assemblies as mentioned above adopt substantially the same basic structure that the both components are engaged with each other by themselves and the locking element merely serves to aid in the engagement of the both components themselves. Thus, the both types of electrical connector assemblies have no particular structure to carry out the function of preventing the connection between the both components from being disconnected accidentally, for example, when an external force acts on the plug.

SUMMARY OF THE INVENTION

It is the primary object of the present invention to provide an electrical connector assembly having the features that a connecting motion of the both components and a pressing motion of the locking element to release the short circuit of a short-circuit element in one of the both components can be carried out in the same motion, that the entire connector assembly can be designed compact, and that the connection between the both components can be prevented from being disconnected accidentally when an external force acts on the electrical connector assembly.

In accordance with one aspect of the invention, there is provided an electrical connector assembly comprising: (1) a first component for supporting a first electrical connector element; (2) a second component for supporting a second electrical connector element inserted in the first electrical connector element to be fitted therein; (3) a short-circuit element, fitted in the first component, for electrically short-circuit the first electrical connector element; and (4) a locking element engageable with the second component in a locked manner, the locking element being so structured that when the second component is inserted in the first component to be fitted therein, the locking element can make the short-circuit element move back to its non-short-circuit position and also can move to engage with the first component, wherein the first component and the second component are locked against disconnection by the engagement of the locking element with the first component. Preferably, a direction for the second component to be inserted in the first component is identical with a direction for the locking element to move to engage with the first component.

According to this construction, the engagement of the both components in such a relation as to be locked against disconnection and the electrical connection therebetween can be provided via the locking element. Further, the release of the short circuit of the short-circuit element in the other component can also be achieved via the locking element. Besides, the locking element is projected from the one component to only an extent necessary for the locking element to be pressed down so as to engage with the other component, the electrical connector assembly can be made compact as a whole. Furthermore, the connecting motion of the both components and the pressing motion of the locking element to release the short circuit of the short-circuit element in the one component can all be carried out in the same motion.

These and other objects, features and advantages of the invention will become more apparent upon a reading of the following detailed specification with reference to the accompanying drawings.

DETAILED DESCRIPTION OF THE PREFERRED EMBODIMENTS

In the following, an embodiment of the present invention will be described. It is to be noted that only a certain preferred embodiment of the present invention is shown for convenience of explanation and is not to be construed as limiting the present invention.

The present invention is particularly suitably applicable to an airbag system for restraining vehicle occupants and, accordingly, the application to the airbag system is illustrated here as an example of the preferred embodiments of the present invention. It is to be understood, however, that the present invention is applicable within a wider range for various different environments and various intended objects, without limiting to the application to the airbag system.

Figure 1:
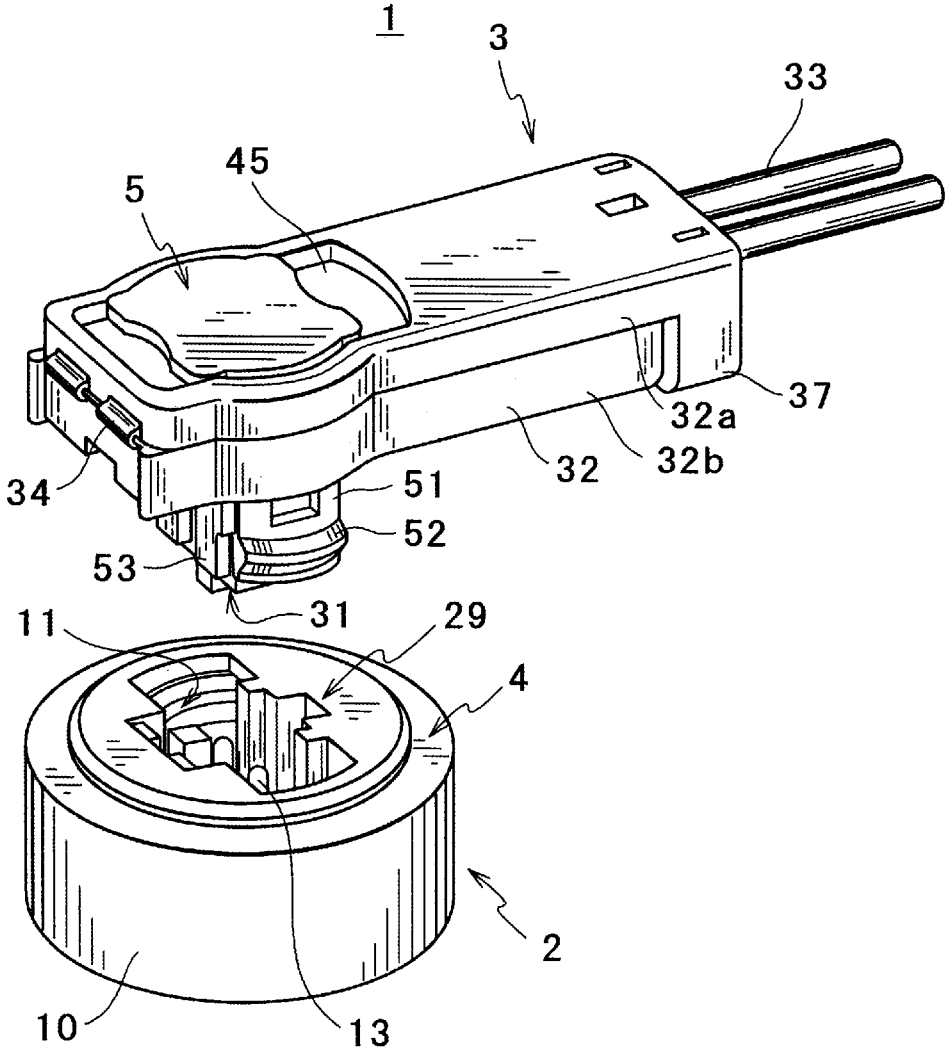
FIG. 1 is a perspective view showing the entire structure of a connector assembly or electrical connector assembly used with an airbag system.

Referring particularly to the accompanying drawings, there is shown in FIG. 1 details of the entire structure of a connector assembly or an electrical connector assembly 1 used with the airbag system. In this diagram, there is shown the connector assembly 1 before connection, which comprises a first component 2 structured in the form of a jack and a second component 3 structured in the form of a plug which is insertable in the first component 2 to be fitted in it.

The first component 2 is provided in the form of a part of an airbag igniter (which is sometimes referred to as a squib) to be electrically connected to an airbag system control system. The igniter is an explosive device which is burnt when sufficient electric energy is applied to it through two conducting wires 33. The burning of the igniter triggers the gas generating material to be ignited and, as a result of this, the airbag is inflated.

A short-circuit element 4 is fitted in the first component 2 with a press-fit. The short-circuit element 4 puts contacts of the first component 2 into the short-circuited state until the components 2 and 3 are mechanically and electrically connected.

The second component 3 is electrically connected with the control system. It is also connected with the first component 2. A locking element 5 is held in the second component 3 in its locked state.

The functions and mutual relations of these various components will be clarified from the following description. Also, as will be obvious from the following description, the second component 3, the short-circuit element 4 and the locking element 5 are preferably formed of proper non-conductive plastic material, except various kinds of wires and contacts.

Figure 7:
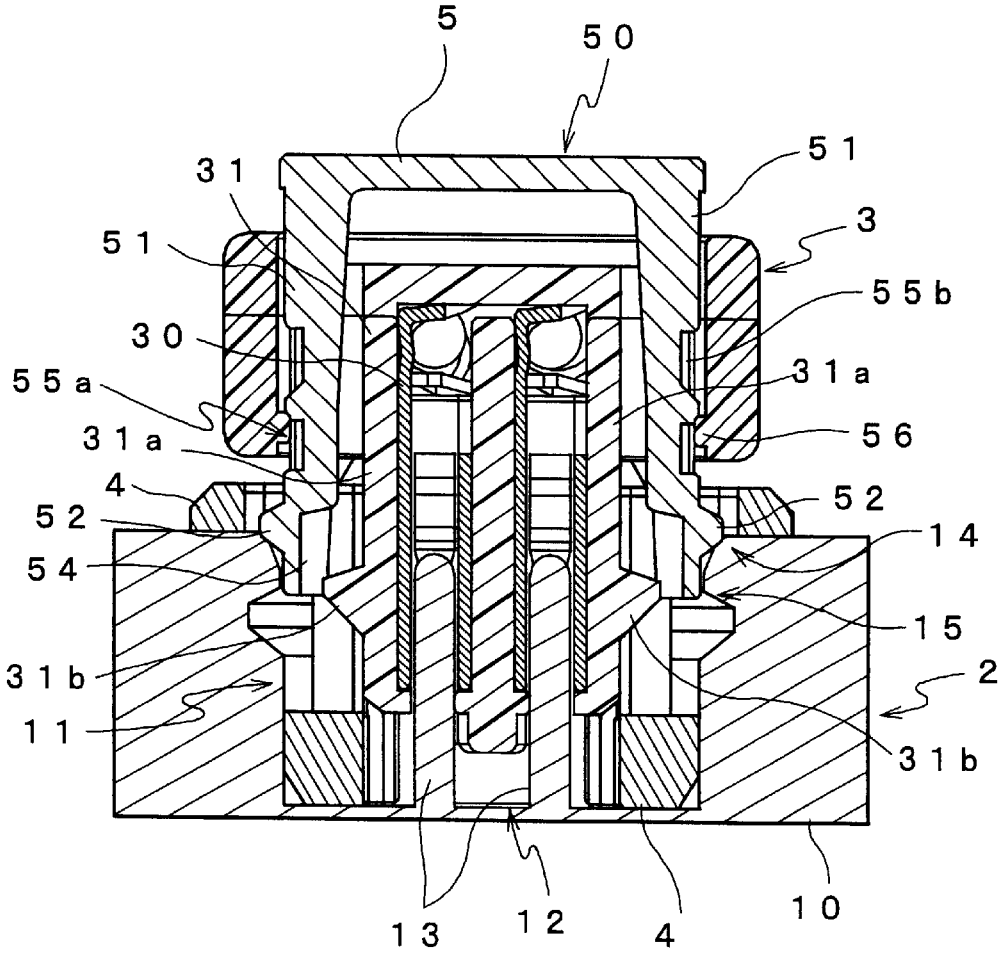
FIG. 7 is a cross sectional view showing the initial connection state of the second component with the first component in which the locking element is in its first position.
Figure 10:
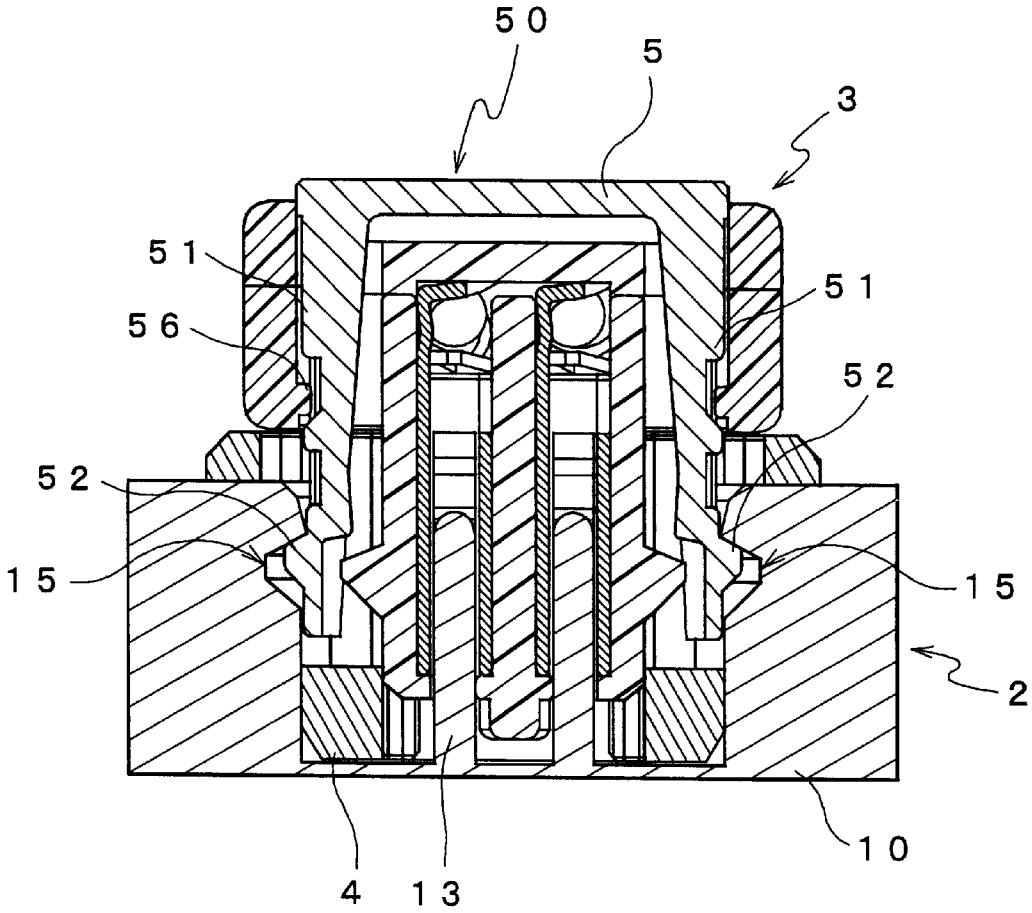
FIG. 10 is a cross sectional view showing a complete connection state of the second component with the first component.
Figure 11:
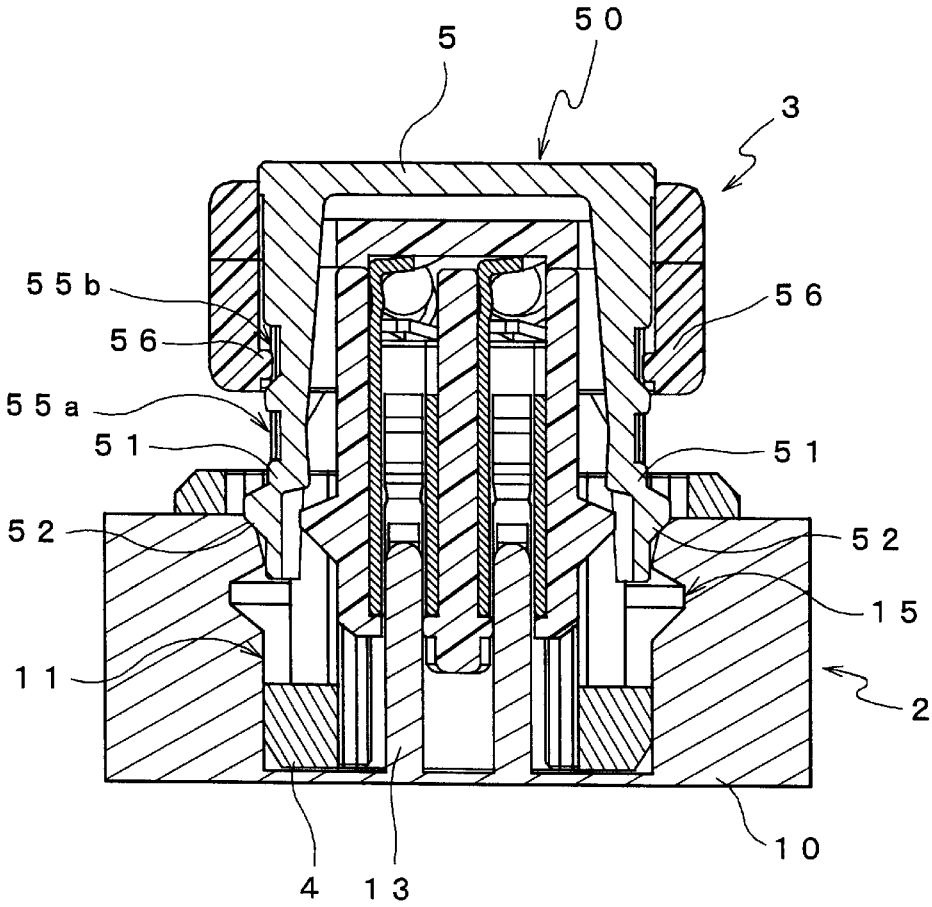
FIG. 11 is a cross sectional view showing the initial connection state of the second component with the first component in which the locking element is in its second position.
Figure 12:
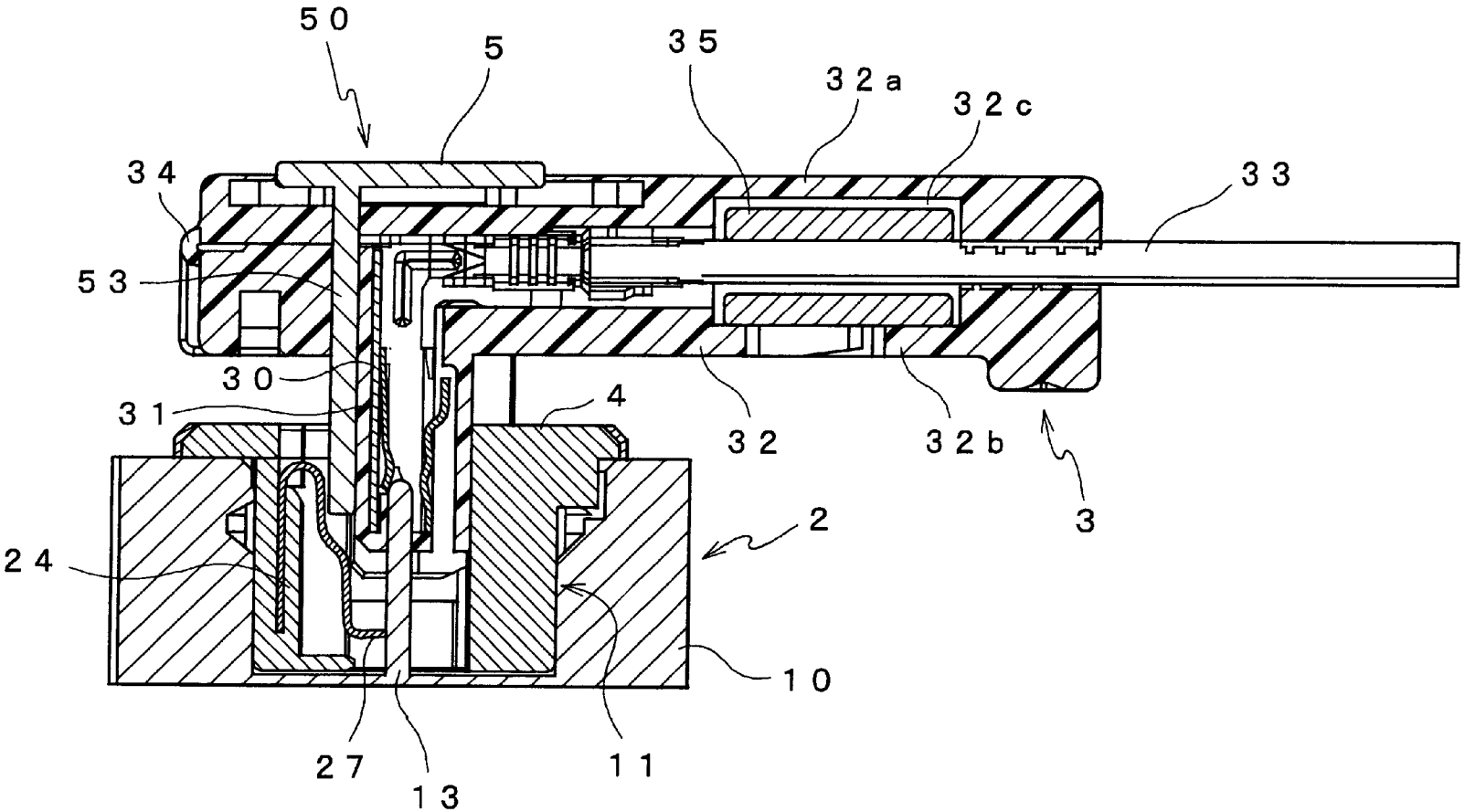
FIG. 12, which corresponds to FIG. 11, is a longitudinal sectional view showing the initial connection state of the second component with the first component.
Figure 13:
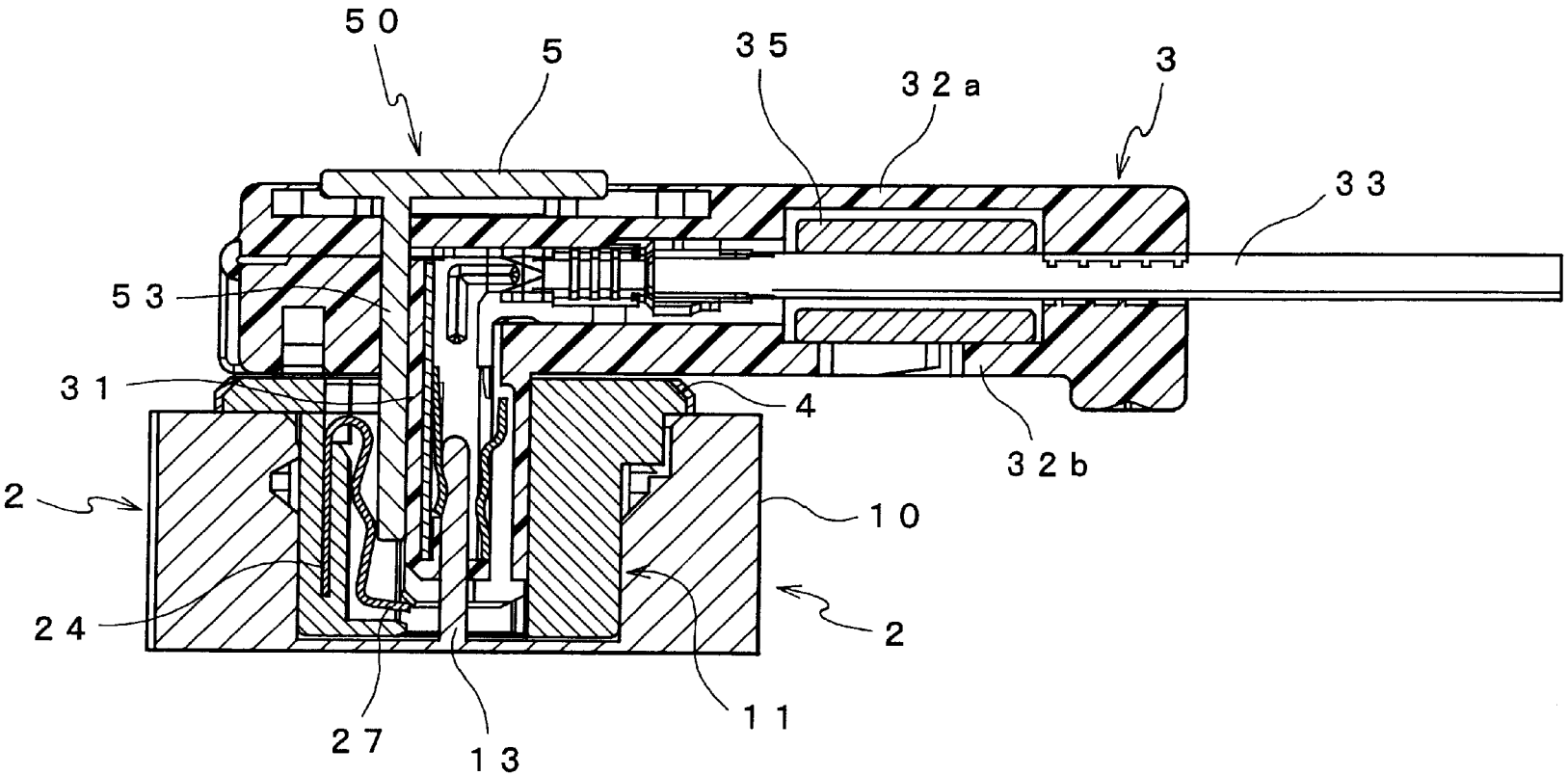
FIG. 13, which corresponds to FIG. 10, is a longitudinal sectional view showing a complete connection state of the second component with the first component.
Figure 14:
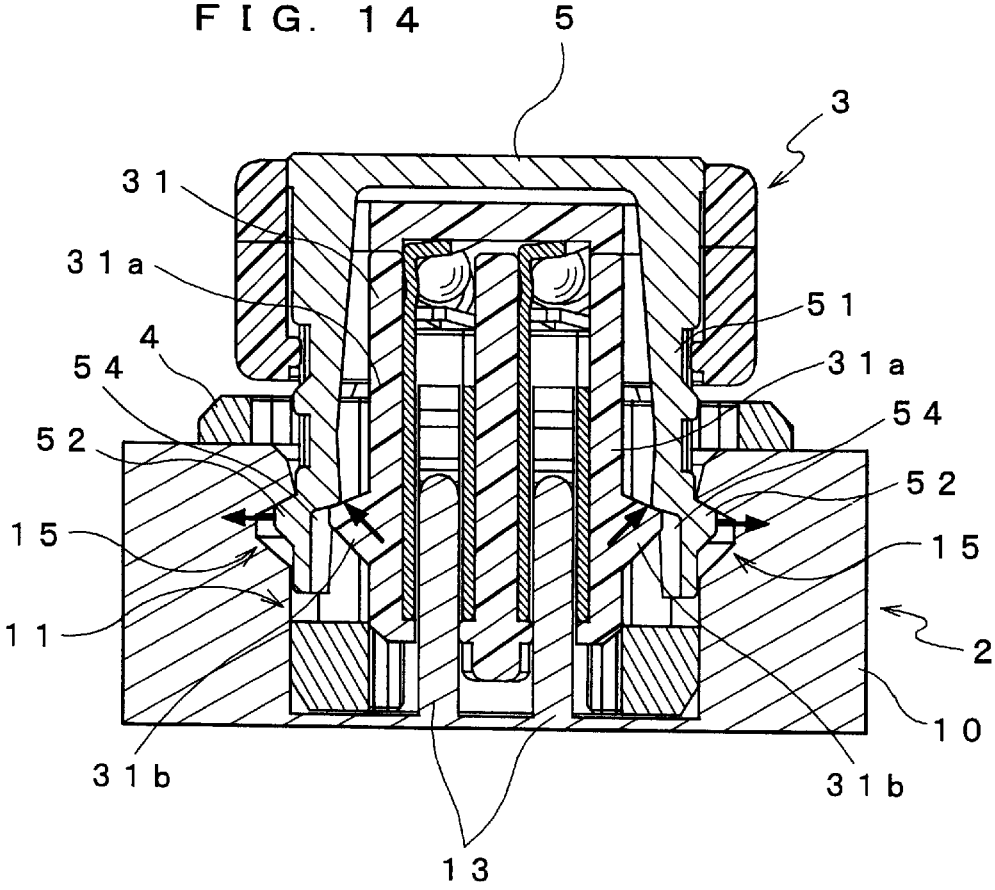
FIG. 14 is a cross sectional view, illustrating the function of preventing the connection between the both components from being disconnected accidentally when an external force acts on the second component.

Referring particularly to the first component 2, this component 2 is formed to have a cylindrical body 10 forming an opening or a socket 11 therein. This first component 2 is shown in FIGS. 1 and 7–14, in particular. FIGS. 7–11 and 14 illustrate in section the connected state of the second component 3 to the first component 2 and these sectional views are taken along the widthwise direction of the second component 3. Similarly, FIGS. 12 and 13 illustrate in section the connected state of the same and these sectional views are taken along the longitudinal direction of the second component 3. The body 10 forming the socket 11 therein can be directly built in its related structure such as an igniter housing. Further, the socket 11 may be formed as a separate element so that it may be added to its related structure. In either configuration, the body 10 forming the socket 11 therein terminates at a bottom wall 12, as shown in FIG. 7, for example. Extended from the bottom wall 12 are a pair of first, conductive, male electrical connector elements or pins 13 formed of metal. These two pins 13 are connected to their respective conducting wires of the airbag igniter (not shown) in any conventional manner. The igniter is electrically energized through the pins 13 so that it can be ignited.

The socket 11 has an inclined surface 14 formed at an entrance thereof. The socket 11 has a locking recess 15 formed in its inner surface to extend continuously in the circumferential direction. As well shown in FIGS. 7 and 11, the inclined surface 14 serves to receive locking portions 52 provided at first legs 51 of the locking element 5, as mentioned later, and produce a deforming moment to move the locking portions 52 toward the center. The locking recess 15 serves to receive the locking portions 52 of the locking element 5 and keep it in its engaged state, as best shown in FIG. 10.

Also, the socket 11 has a semicircular concave portion at one location around the entrance thereof, though not shown in any diagrams. The semicircular concave portion is so formed as to fit with a corresponding semicircular lug (not shown) provided in the short-circuit element 4 when the short-circuit element 4 is disposed in the socket 11. This determines the setting of orientation of the short-circuit element 4, as shown in FIG. 1.

The short-circuit element 4 is received in the socket 11. The short-circuit element 4 serves to provide the short-circuit by keeping the male electrical connector elements 13 in the state of being electrically connected therebetween until the second component 3 is inserted in the first component 2 to fit with it and further the locking element 5 locked in the second component 3 is brought into engagement with the first component 2.

Figure 5:
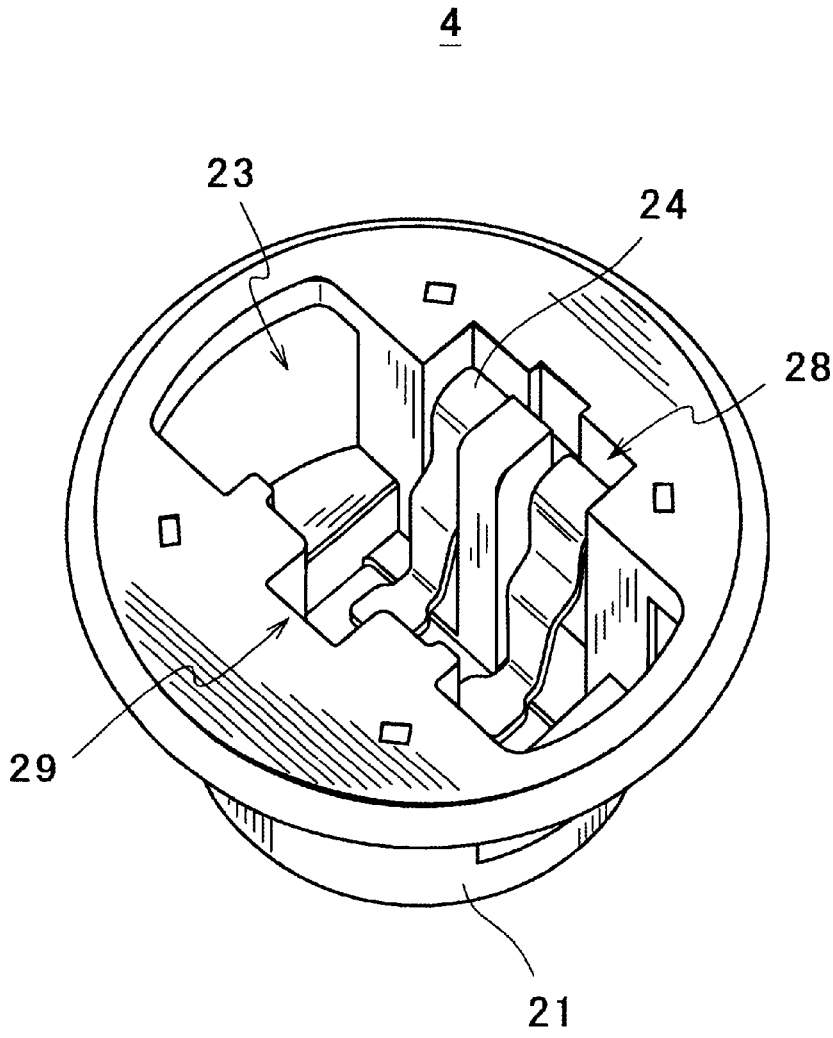
FIG. 5 is a perspective view of a short-circuit element.

Shown in FIG. 5 is a perspective view of the short-circuit element 4. The short-circuit element 4 has a molded plastic body 21 of a generally cylindrical shape having a dimension to tightly fit in the socket 11. The body 21 of the short-circuit element 4 is provided, at its sides on the top, with semi-columnar projecting portions that are extended short downwardly therefrom so as to correspond in location and size to the concave portions provided in the socket 11 so that they can be snugly received in the concave portions, though not shown in FIG. 5. Those projecting portions serve to determine the orientation of the short-circuit element 4 with respect to the socket 11. Further, the body 21 of the short-circuit element 4 has an opening 23 into which the male electrical connector elements or pins 13 are extended passing therethrough. The opening 23 is formed to open to the top at the center portion of the short-circuit element 4 and to both lateral sides thereof. FIGS. 7–11 and 14 show the sectional views including the section of the opening 23.

A short-circuit clip 24 is held in the body 21 of the short-circuit element 4. The short-circuit clip 24 is formed of conductive material having elasticity such as spring steel. A part of the short-circuit clip 24 is deflected to the direction of its abutting with the pins 13. The abutment of the short-circuit clip 24 with the pins 13 provides an electrical short-circuit therebetween.

Figure 6:
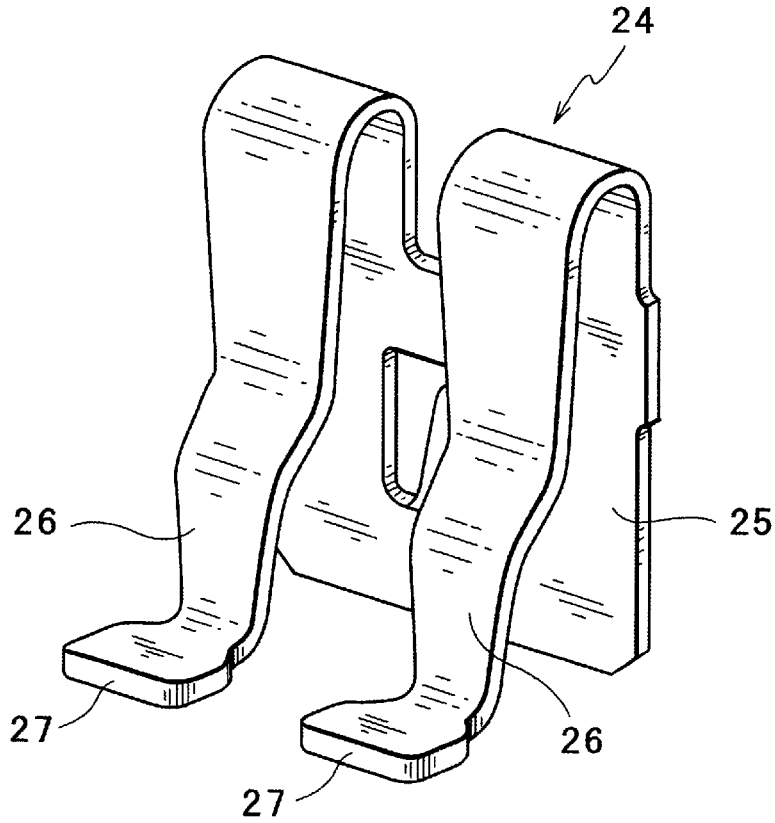
FIG. 6 is a perspective view of a short-circuit clip.

A perspective view of the short-circuit clip 24 is shown in FIG. 6. The short-circuit clip 24 comprises a plate-form base 25, a pair of legs 26 folded back at the top of the base 25 and extending downward therefrom and a pair of abutting portions 27 folded at an angle of 90 degree at the lower end portions of the legs 26. Each of the legs 26 is folded and deflected stepwise in the direction of its being away from the base 25. The abutting portions 27 of the short-circuit clip 24 are brought into abutment with lateral sides of the both pins 13 to electrically connected therewith. As shown in FIG. 5, the short-circuit clip 24 is held in the body 21 of the short-circuit element 4, with its base 25 inserted in a slit-like recess 28 of the short-circuit clip 4 so as not to slip off.

The short-circuit element 4 is set in position in the socket 11, so that the lateral sides of the two pins 13 are abutted with the abutting portions 27 of the short-circuit clip 24 at the lower portions thereof, to be electrically connected therewith. The two pins 13 extend upwardly within the opening 23. In FIG. 12, in which there is shown a longitudinal sectional view showing the initial connection state of the second component 3 with the first component 2, there is shown the state that the abutting portions 27 of the short-circuit clip 24 are in contact with the pins 13.

The second component 3 of the connector assembly or electrical connector assembly 1 will be best understood with reference to FIGS. 1, 2 and 7–14. As shown in these figures, the second component 3 includes a body portion 32 or a central plug portion 31 extending downwardly and supporting a pair of electrical terminals 30 which are in the form of second female connector elements (See FIGS. 2, 7 and 12). The electrical terminals 30 are electrically connected with the conductors 33. These electrical terminals 30 are formed to have configuration and size to receive the pins 13 of the first component 2 therein.

For example, as shown in FIGS. 7 and 12, the electrical terminals 30 built in the central plug portion 31 each extend from the tubular terminal portions forming the second female connector element and change in direction in a generally L-form so as to be connected with the two conductors 33. The conductors 33 are the insulation armored wires. These wires are peeled at the ends thereof so as to be electrically and mechanically attached to the electrical terminals 30. The attachment of the wires is usually performed by press-fitting a part of the electrical terminals 30 around the bare wires at the ends thereof in any conventional manner.

Figure 2:
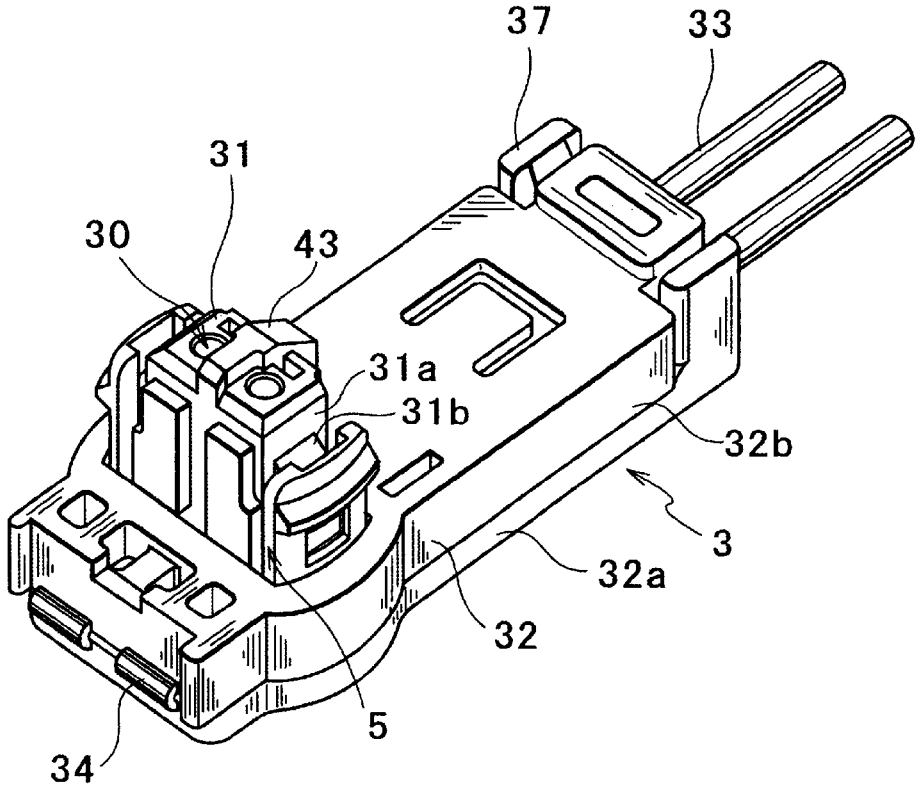
FIG. 2 is a perspective view, as viewed from bottom, of the second component in which a locking element is locked.

In FIG. 1, 2 or 12, the second component 3 includes the central plug portion 31 and the box-shaped body portion 32 arranged in the generally L-form with respect to the central plug portion 31, as previously mentioned. The body portion 32 comprises upper body portion 32*a* and a lower body portion 32*b* which can be diverged from each other with their one ends coupled via a flexible coupling portion 34. The upper and lower body portions 32*a* and 32*b* can be folded on the coupling portion 34 to form a combined body of a generally rectangular parallelepiped form. Specifically, these two body portions 32*a* and 32*b* are formed into the combined body of generally rectangular parallelepiped form by the engagement of a pair of spaced, elastic tab extensions 37 extending downwardly from the end of the upper body portion 32*a* with a pair of engaging portions (not shown) formed at the end of the lower body portion 32*b*. This can allow the two body portions 32*a* and 32*b* of the second component 3 to be retained in a proper engagement relation therebetween, as shown in FIGS. 1 and 2.

In FIG. 12, the second component 3 has a box-shaped space 32*c* in a part thereof between the upper body portion 32*a* and the lower body portion 32*b*. A ferrite bead 35, through which the conductors 33 pass, is placed in the space 32*c*. The ferrite bead 35 is a generally box-shaped homogeneous substance having two tubular thru holes extending in parallel with each other, and the conductors 33 pass through the thru holes of the ferrite bead 35.

The central plug portion 31 has a generally square cylinder form and has a ridge 43, as best shown in FIG. 2. The ridge 43 is formed and arranged in size and location to engage with a recess 29 opening to the top of the short-circuit element 4 shown in FIG. 1. The engagement of the ridge 43 in the recess 29 ensures a proper connection between the two electrical terminals 30 of the second component 3 and the two pins 13 of the first component 2.

As best shown in FIG. 1, the upper body portion 32*a* of the second component 3 has a wide shallow recess 45 formed on an upper surface thereof at a location corresponding to the central plug portion 31. It also has a perforated opening, though not shown, in which the first legs 51 and the second legs 53 of the locking element 5 are inserted from the shallow recess 45 toward the central plug portion 31. When the locking element 5 is inserted in the second component from the perforated opening, the central plug portion 31 is so placed that its lateral sides are held in sandwich relation by the locking element 5. As well shown in FIGS. 2 and 7, the central plug portion 31 has, in its terminal holding portions 31*a* holding the electrical terminals 30 and spaced widthwise from each other, outwardly projecting lug portions 31*b* formed to extend along a part of a recessed portion 54 (mentioned later) formed in the locking element 5.

Figure 3:
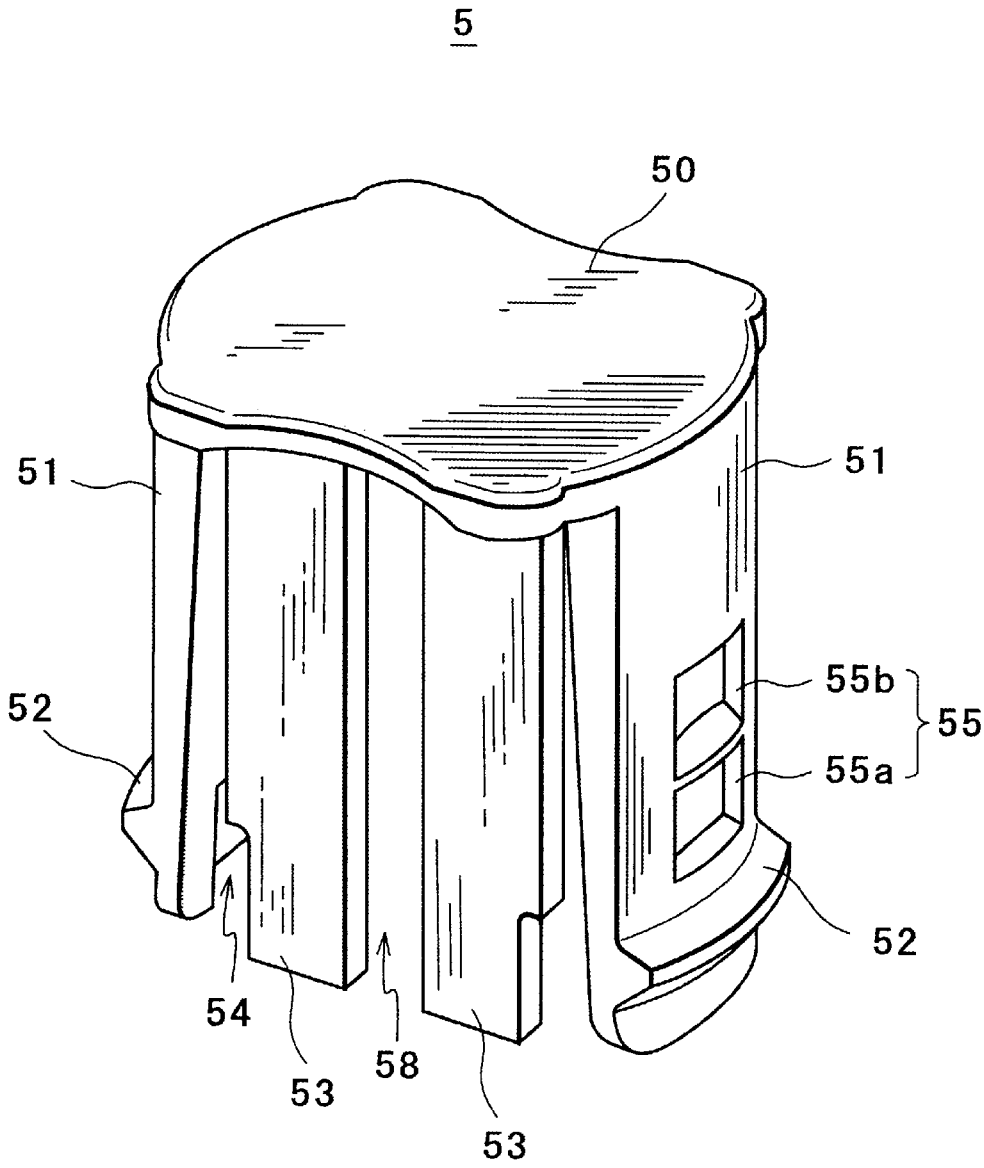
FIG. 3 is a perspective view, as viewed from top, of the locking element.
Figure 4:
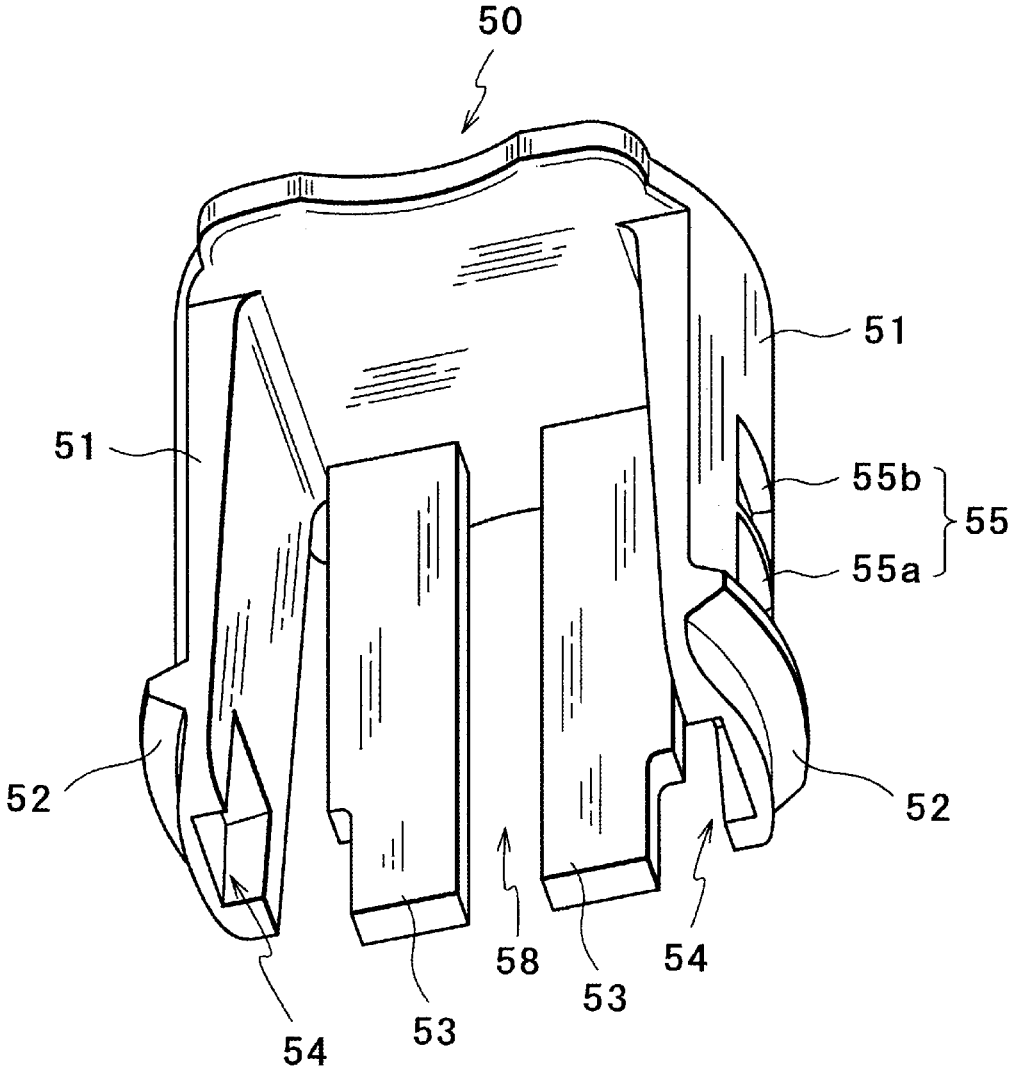
FIG. 4 is a perspective view, as viewed from bottom, of the locking element.

FIGS. 3 and 4 show a perspective view of the locking element 5. The locking element 5 includes a head portion or pressing portion 50, a pair of first legs 51 extending downwardly from both widthwise sides of the pressing portion 50, and a pair of second legs 53 arranged in a row and extending downwardly from one lengthwise end of the pressing portion 50. The first legs 51 and the second legs 53 are so disposed as to be in the planes meeting at generally right angles with each other. Specifically, the first legs 51 and the second legs 53, which are so disposed as to be in the planes meeting at generally right angles with each other, are arranged in such a manner that the first legs 51 are spaced to confront each other and also the second legs 53 are arranged to be symmetric with respect to a slit 58. These legs are formed and arranged in size and location to be inserted in the perforated opening formed in the upper body portion 32*a* of the second component 3. This can allow the locking element 5 to be retained in a proper engagement relation, as shown in FIG. 1.

Each of the first legs 51 has the outwardly projecting locking portion 52 at a lower portion thereof on the opposite side to the mutually confronting side. The locking portions 52 are formed and arranged in size and location to be engageable in the locking recess 15 formed in the socket 11, as best shown in FIG. 10. This can provide the result that when the locking element 5 is pressed in the direction for the first and second components 2 and 3 to be connected with each other, the both components are brought into engagement in such a manner as to be locked against disconnection via the locking element 5.

As well shown in FIG. 4, the first legs 51 have recessed portions 54 at opposed portions thereof on substantially the back sides of the locking portions 52. The recessed portions 54 are so formed as to be engageable with the lug portions 31*b*, which are provided on the terminal holding portions 31*a* of the central plug portion 31 disposed in sandwich relation between the first spaced legs 51, when the locking portions 52 are in engagement in the locking recess 15. This ensures that the first component 2 and the second component 3 are held in their connected state further tightly. This connected state is well shown in FIG. 14. If an external force acts on the second component 3 when the locking portions 52 are in engagement in the locking recess 15, the terminal holding portions 31*a* having flexibility will be deflected so that the lug portions 31*b* can press the recessed portions 54 in the direction for the locking portions 52 and the locking recess 15 to be engaged with each other. Thus, the first legs 51 confronting each other are pressed from the inside and stretched out. As a result of this, even when an external force acts on the electrical connector assembly 1, the first component 2 and the second component 3 can be locked further tightly against disconnection to prevent the connection between the both components from being disconnected accidentally. The related actions of the lug portions 31*b* with the first legs 51 are indicated by arrows in FIG. 14. This construction can easily provide the structure to prevent the both components from being disconnected accidentally.

In FIGS. 3 and 4, the first legs 51 have, at intermediate portions thereof above the locking portions 52, two rectangular recessed portions 55 which are spaced apart in a vertical direction or in a direction for the second component 3 to be inserted in the first component 2, so as to face outwardly. The recessed portions 55 each comprise, in lower-to-upper order, a first recessed portion 55*a* and a second recessed portion 55*b*. These two recessed portions 55 are each engageable with a retaining projection 56 of the second component 3, as best shown in FIGS. 7 and 11. This allows the locking element 5 to be locked at the two positions when inserted in the second component 3. It is to be noted that the related position of the locking element 5 when locked at the first recessed portions 55*a* is defined as the first position and the related position of the locking element 5 when locked at the second recessed portions 55*b* is defined as the second position. The first recessed portions 55*a* are so formed that when the locking element 5 is in the first position, it can be locked, with the pressing portion 50 of the locking element 5 and the front ends of the first legs 51 projected from the second component 3 in the directions opposite to each other, to form a generally T shape (See FIG. 7). The second recessed portions 55*b* are so formed that when the locking element 5 is in the second position, it can be locked, with the pressing portion 50 nearly sunk in the shallow recess 45 of the second component 3 and only the front ends of the first legs 51 projected from the second component 3, to form a generally L shape (See FIGS. 1, 11 and 12).

As best shown in FIGS. 3 and 4, the second legs 53 are each formed in a plate-like form and are extended downwardly side by side, with the slit 58 sandwiched therebetween. The slit 58 extends from the backside of the head or pressing portion 50 to the ends of the second legs 53. When the second legs 53 are inserted up to their roots in the penetrated opening, the head 50 is completely accommodated in the shallow recess 45. The provision of the slit 58 can allow for a sufficient mechanical strength of the electrical connector assembly by the insertion of the locking element 5, even when the second component 3 has the penetrated opening at its upper body portion 32*a*. As best shown in FIGS. 12 and 13, when the locking element 5 is pressed in the first component 3, the second legs 53 are advanced up to the folded portion of the short-circuit clip 24. This serves to move the abutting portions 27 away from the pins 13 to release the electrical connection with the pins 13.

As described above, the locking element 5 has the pair of first legs 51 and the pair of second legs 53, and the first legs 51 and the second legs 53 are so disposed as to be in the planes meeting at generally right angles with each other. In addition, the first legs 51 and the second legs 53, which are so disposed as to be in the planes meeting at generally right angles with each other, are arranged in such a manner that the first legs 51 are spaced to confront each other. This construction can provide the results that the locking element 5 can allow the both components 2 and 3 to be engaged with each other in such a manner as to lock the both components against disconnection and can also allow the both components 2 and 3 to be electrically connected with each other, and can further allow the short circulation provided by the short-circuit element 4 in the first component 2 to be released with ease.

As will be mentioned later, the locking element 5, when pressed in, can allow the first legs 51, which have the locking portions 52, one for each, at the opposite side to the mutually confronting side, to be deflected, first, and then resiliently restored to engage in the locking recess 15 formed in the first component 2, so as to fit in it. This construction can provide the results that the locking element 5 can allow the both components 2 and 3 to be engaged with each other in such a manner as to lock the both components against disconnection and can also allow the both components 2 and 3 to be electrically connected with each other, and can further allow the short circulation provided by the short-circuit element 4 in the first component 2 to be released with ease.

The connector assembly or electrical connector assembly 1 according to the embodiment of the invention is constructed as described above. Now, the connecting operation of the electrical connector assembly 1 will be described with reference to FIGS. 1 and 7–13. As shown in FIG. 1, the short-circuit element 4 is previously fitted in the socket 11 of the first component 2 to provide the electrical short-circuit of the pins 13, and the locking element 5 is previously locked in position against the second component 3. Though FIG. 1 shows the state that the locking element 5 is locked in the second position, the locking element 5 may be locked in the first position as well. Also, the locking element 5 can be pressed from either of the positions to engage with the first component 2, as mentioned later.

FIG. 7 shows the state that paralleled portions of the plug portion 31 at the lower end thereof are inserted deep in the socket 11 of the first component 2 by an operator holding both sides of the body portion 32 of the second component 3 with his/her hand. In FIG. 7, the locking element 5 is locked in the first position with respect to the second component 3. In this position, the locking element 5 is locked, taking a generally T form, with the pressing portion 50 projected upwardly, from which the operator can visually judge that the electrical connection between the first and second components has not yet been completed. This can provide improved working efficiency in the assembling work using the electrical connector assembly 1.

In this electrical connector assembly 1, whether the locking element 5 is in the first position or in the second position, when the locking element 5 is pressed from that position, the engaging motion of the second component 3 into the first component 2 for a fit therein and the engaging motion of the locking element 5 into the first component 2 can be performed in the continuous motion. Hence, even when the locking element 5 is accidentally pressed by external force and the like acting thereon in the course of the transmission of the electrical connector assembly 1, such that the locking element 5 is disengaged from the first position and is shifted therefrom to the second position in which the locking element 5 takes the generally L form, the connection beteen the both components 2 and 3 can be provided by simply pressing the locking element 5 as it is, without restoring it to the first position. FIG. 11 shows the initial state of insertion of the locking element 5 into the first component 2, with the locking element 5 locked in the second position. FIGS. 7 and 11 both show the initial state of insertion of the second component 3 into the first component 2. In this initial state, the locking portions 52 of the locking element 5 rest on the inclines surface 14 at the entrance of the socket 11 in abutment therewith.

Figure 8:
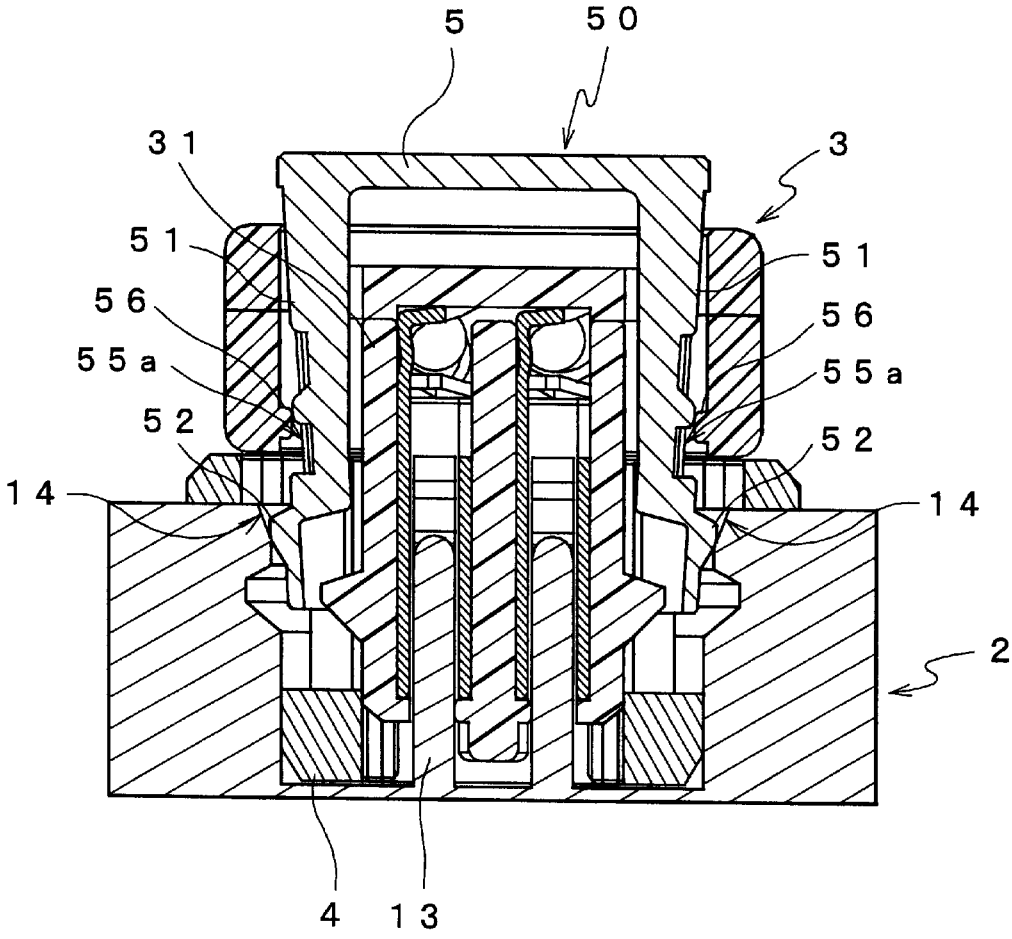
FIG. 8 is a cross sectional view showing an intermediate connection state of the second component with the first component.
Figure 9:
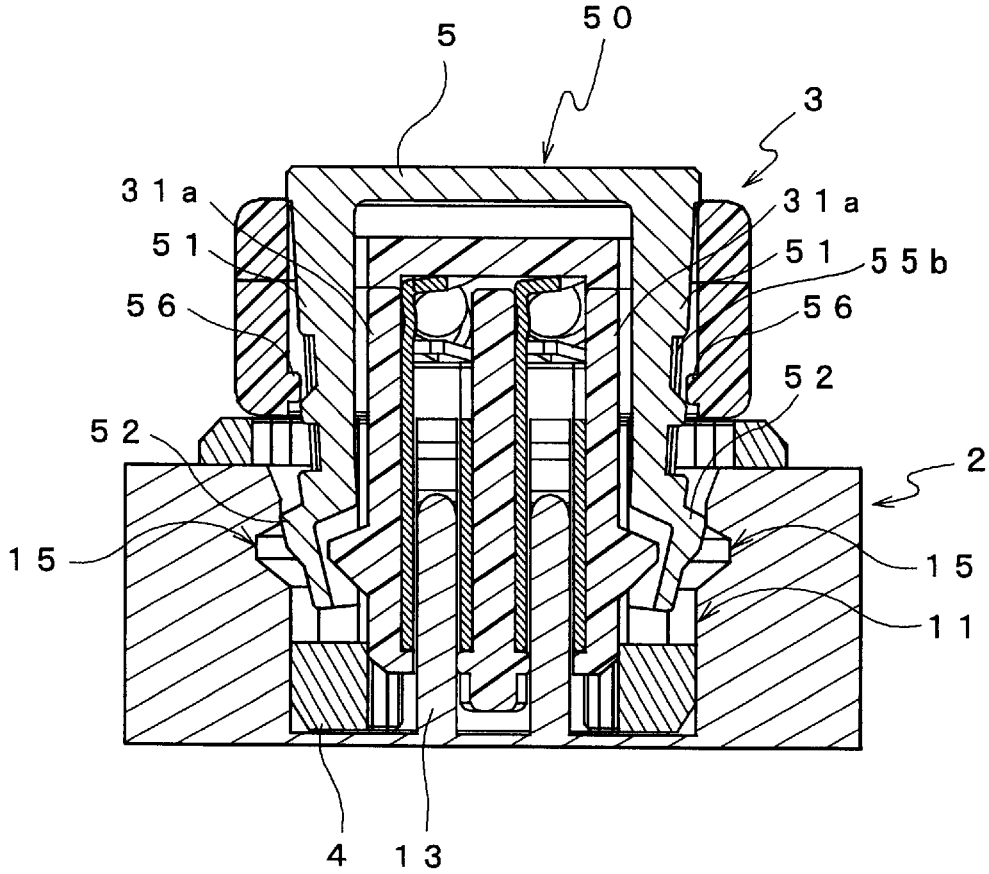
FIG. 9 is a cross sectional view showing an intermediate connection state of the second component with the first component.

When the pressing portion 50 of the locking element 5 is pressed from this state, for example, with a thumb, an inward moment acts on the first legs 51. FIG. 8 shows the intermediate state of the connection produced when the locking element 5 is pressed from the initial state shown in FIG. 7 in which it is locked in the first position. In this state, the first legs 51 are deflected inwardly by the reaction force acting thereon from the entrance of the socket 11 through the locking portions 52. The deflection of the first legs 51 operates to disengage the engagement between the first recessed portions 55*a* and the retaining projections 56 simultaneously. This intermediate state is shown in FIG. 9. In FIG. 9, there is represented the state in which the retention of the retaining projections 56 in the first recessed portions 55*a* is released and the related position of the retaining projections 56 is changed so that the level of the retaining projections 56 can be even with the second recessed portions 55*b*. When the pressing portion 50 is pressed from the state of FIG. 11 in which the locking element 5 is locked in the second position, the locking element 5 is shifted from that state to the intermediate state shown in FIG. 9.

Thus, the first legs 51, after deflected, are resiliently restored and the locking portions 52 are fitted in the locking recess 15, as shown in FIG. 10, whereby the engagement between the locking element 5 and the first component 2 is completed. As a result of this, the connection between the first component 2 and the second component 3 comes into the state of perfection. At the same time, the pins 13 are inserted in the electrical terminals 30 built in the plug portion 31 of the second element 3 and thereby the electrical connection therebetween is also achieved.

Not only the connection between the first component 2 and the second component 3 but also the release of the short-circulation between the pins 13 provided by the short-circuit clip 24 of the short-circuit element 4 is achieved by the same pressing-down motion of the locking element 5. The released state of the short circulation is shown in FIGS. 12 and 13. FIG. 12, which corresponds to FIG. 11, is a longitudinal sectional view showing the initial connecting state of the second component 3 with the first component 2. In FIG. 12, the short circuit of the pins 13 provided by the short-circuit clip 24 still remains. On the other hand, in FIG. 13 showing the state in which the pressing motion of the locking element 5 is completed for engagement, the second legs 53 of the locking element 5 are advanced to the folded portion of the short-circuit clip 24 and thereby the abutting portions 27 are moved away from the pins 13 to release the short circuit of the pins 13.

As described above, the mechanical engagement between the first component 2 and the second component 3 and the electrical fitting connection therebetween are both perfectly completed via the locking element 5 in the same pressing motion of the locking element 5. For example, if an external force acts on the second component 3 through the cables 33 when the first component 2 and the second component 3 are in the connected state, the terminal holding portions 31*a* of the central plug portion 31 will be deflected and then the lug portions 31*b* at the terminal holding portions 31*a* will bias the recessed portions 54 provided at the first legs 51 of the locking element 5 in the direction for the locking portions 52 and the locking recess 15 to be engaged with each other. As a result of this, the first component 2 and the second component 3 can be locked further tightly against disconnection to prevent the connection between the both components from being disconnected accidentally (See FIG. 14).

Once the connection of the second component 3 with the first component 2 is completed, it becomes impossible to remove the second component 3 from the first component 2, unless only the locking element 5 is raised, for example, by using as a lever a sharp-end clip or the like inserted in between the pressing portion 50 of the locking element 5 and the shallow recess 45 of the second component 3.

As described above, according to this electrical connector assembly 1, the engagement of the both components 2 and 3 in such a manner as to be locked against disconnection and the electrical connection therebetween can both be provided via the locking element 5 and, further, the release of the short circuit by the short-circuit element 4 in the first component 2 can also be achieved via the locking element 5. Besides, since the locking element 5 is projected from the second component 3 to only an extent necessary for the locking element 5 to be pressed down so as to engage with the second component 3, the electrical connector assembly 1 can be made compact as a whole.

Furthermore, the connecting motion of the both components 2 and 3 and the pressing motion of the locking element 5 to release the short circuit of the short-circuit element 4 can be carried out in the same motion.

Moreover, the connecting motion of the both components 2 and 3 and the pressing motion of the locking element 5 to release the short circuit of the short-circuit element 4 can all be carried out in the single motion.

In summary, according to the electrical connector assembly 1 according to the illustrated embodiment, the connecting motion of the both components and the pressing motion of the locking element to release the short circuit of the short-circuit element in the one of the both components can both be carried out in the same motion; also the entire connector assembly can be designed compact; and yet the connection between the both components can be prevented from being disconnected accidentally when an external force acts on the electrical connector assembly.

While the present invention has been described in its preferred embodiment, it is to be understood that it is intended to cover in the appended claims all variants, modifications, applications and equivalents thereof that will be obvious as fall within the scope of the appended claims upon reading and understanding the specification.

For example, the pair of legs 26 of the short-circuit clip 24 may be presented in the form of a sheet of plate. The pair of abutting portions 27 formed by bending the front ends of the legs 26 at an angle of 90 degree may take any suitable configuration to directly contact with the pins 13, without limiting to the configuration as shown in the illustrated embodiment.

Also, the locking element 5 may take a configuration wherein the slit 58 formed between the second legs 53 is not formed. This means that the locking element 5 may take such a configuration that the second leg 53 of a single-sheet-plate form is arranged between the pair of first legs 51 so that a generally U-like shape can be formed by the first legs 51 and that second leg 53.

In addition, the locking element 5 according to the present invention is applicable not only to the electrical connector assembly 1 according to the present invention that is so structured that the locking and the release of the short circuit can both be performed in the same motion, but also to a conventional type of electrical connector assembly that is so structured that the locking and the release of the short circuit are performed by different motions.

What is claimed is:

1. An electrical connector assembly comprising:

a first component for supporting a first electrical connector element;

a second component for supporting a second electrical connector element inserted in the first electrical connector element to be fitted therein;

a short-circuit element, fitted in the first component, for electrically short-circuiting the first electrical connector element; and a locking element engageable with the second component in a locked manner, the locking element being so structured that when the second component is inserted in the first component to be fitted therein, the locking element can make the short-circuit element move back to its non-short-circuit position and also can move to engage with the first component, wherein the locking element has a pair of first legs and a pair of second legs, the pair of first legs and the pair of second legs being so disposed as to be in the planes meeting at generally right angles with each other and being arranged in such a relation that the first legs are symmetrically spaced to confront each other, wherein the first legs have locking portions, one for each, at the opposite side to the mutually confronting side and are so structured that when the locking portions are biased, the first legs can be deflected first and then resiliently restored to bring the locking portions into engagement in a locking recess formed in the first component, so as to fit in it so that the locking element is engaged with the first component, and wherein the first legs have recessed portions at opposed portions thereof on substantially the back sides of the locking portions, and the second component has, on its portions located in a sandwich relation between the first legs confronting each other and having flexibility, lug portions formed to extend along a part of the recessed portions, so that when an external force acts on the second component when the locking portions are in engagement in the locking recess, the portions having flexibility are deflected so that the lug portions can press the recessed portions in the direction for the locking portions and the locking recess to be engaged with each other and thereby the first component and the second component are locked against disconnection.

2. The electrical connector assembly according to claim 1, wherein a direction for the second component to be inserted in the first component is identical with a direction for the locking element to move to engage with the first component.

3. The electrical connector assembly according to claim 2, wherein the insertion of the second component in the first component to be fitted therein and the movement of the locking element to engage with the first component are continuously performed in the pressing motion of the locking element.

4. The electrical connector assembly according to claim 2, wherein the locking element is engageable with the second component in a locked manner at two locations of a first position and a second position which are spaced from each other in the direction for the second component to be inserted in the first component.

5. The electrical connector assembly according to claim 4, wherein the insertion of the second component in the first component to be fitted therein and the movement of the locking element to engage with the first component are continuously performed in the pressing motion of the locking element from either of the first position and the second position.

6. The electrical connector assembly according to claim 2, wherein when an external force that allows for disengagement of the second component from the first component in an insertion direction thereof acts on the second component when the locking element is in engagement in the first component, portions of the second component located in a sandwich relation between the first legs confronting each other are deflected and then the first legs confronting each other are biased from the inside and stretched out, whereby the first component and the second component are locked further tightly against disconnection.

7. An electrical connector assembly connectable with a first component supporting a first connector element, the electrical connector assembly comprising:

a second component for supporting a second electrical connector element inserted in the first electrical connector element to be fitted therein;

a short-circuit element, fitted in the first component, for electrically short-circuiting the first electrical connector element; and a locking element to be previously engaged with the second component in a locked manner, the locking element being so structured that when the second component is inserted in the first component to be fitted therein, the locking element can make the short-circuit element move back to its non-short-circuit position and also can move to engage with the first component, wherein the locking element has a pair of first legs and a pair of second legs, the pair of first legs and the pair of second legs being so disposed as to be in the planes meeting at generally right angles with each other and being arranged in such a relation that the first legs are symmetrically spaced to confront each other, wherein the first legs have locking portions, one for each, at the opposite side to the mutually confronting side and are so structured that when the locking portions are biased, the first legs can be deflected first and then resiliently restored to bring the locking portions into engagement in a locking recess formed in the first component, so as to fit in it, so that the locking element is engaged with the first component, and wherein the first lees have recessed portions at opposed portions thereof on substantially the back sides of the locking portions, and the second component has, on its portions located in a sandwich relation between the first legs confronting each other and having flexibility, lug portions formed to extend along a part of the recessed portions, so that when an external force acts on the second component when the locking portions are in engagement in the locking recess, the portions having flexibility are deflected so that the lug portions can press the recessed portions in the direction for the locking portions and the locking recess to be engaged with each other and thereby the first component and the second component are locked against disconnection.

8. The electrical connector assembly according to claim 7, wherein a direction for the second component to be inserted in the first component is identical with a direction for the locking element to move to engage with the first component, whereby the insertion of the second component in the first component to be fitted therein and the movement of the locking element to engage with the first component are continuously performed in the pressing motion of the locking element.

* * * * *